US006615721B1

(12) United States Patent
Vrotacoe et al.

(10) Patent No.: US 6,615,721 B1
(45) Date of Patent: Sep. 9, 2003

(54) METHOD AND DEVICE FOR MANUFACTURING A TUBULAR LITHOGRAPHIC PRINTING BLANKET

(75) Inventors: James Brian Vrotacoe, Rochester, NH (US); Roland Thomas Palmatier, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/716,696

(22) Filed: Nov. 20, 2000

(51) Int. Cl.[7] ..... B41N 10/00

(52) U.S. Cl. ..... 101/375; 101/401.1; 29/895.32; 156/429; 428/909; 492/56

(58) Field of Search ..... 101/217, 375, 101/376, 401.1; 428/909; 29/895.21, 895.211, 895.3, 895.32; 492/16, 18, 49, 53, 56; 156/244.11, 244.12, 244.13, 244.16, 244.18, 425, 429, 430, 431

(56) References Cited

U.S. PATENT DOCUMENTS

| | | | | |
|---|---|---|---|---|
| 5,206,992 A | * | 5/1993 | Carlson et al. | 101/376 |
| 5,301,610 A | * | 4/1994 | McConnell | 101/375 |
| 5,304,267 A | | 4/1994 | Vrotacoe et al. | 156/86 |
| 5,323,702 A | | 6/1994 | Vrotacoe et al. | 101/217 |
| 5,352,507 A | * | 10/1994 | Bresson et al. | 428/909 |
| 5,429,048 A | | 7/1995 | Gaffney et al. | 101/217 |
| 5,440,981 A | | 8/1995 | Vrotacoe et al. | 101/217 |
| 5,544,584 A | * | 8/1996 | Thompson et al. | 101/375 |
| 5,553,541 A | | 9/1996 | Vrotacoe et al. | 101/217 |
| 5,700,343 A | * | 12/1997 | Castelli et al. | 428/909 |
| 5,768,990 A | | 6/1998 | Vrotacoe et al. | 101/217 |
| 5,798,019 A | * | 8/1998 | Cushner et al. | 156/425 |
| 5,974,973 A | * | 11/1999 | Tittgemeyer | 101/375 |
| 6,080,258 A | * | 6/2000 | Tittgemeyer | 156/192 |
| 6,257,140 B1 | * | 7/2001 | Palmatier et al. | 101/401.1 |
| 6,289,809 B1 | * | 9/2001 | Sonobe | 101/376 |

FOREIGN PATENT DOCUMENTS

| | | |
|---|---|---|
| DE | 19720549 | 5/1997 |
| EP | 878249 | * 11/1998 |

OTHER PUBLICATIONS

Abstract of DE 19720549 (In English).

* cited by examiner

*Primary Examiner*—Stephen R. Funk
(74) *Attorney, Agent, or Firm*—Davidson, Davidson & Kappel, LLC

(57) ABSTRACT

A device for manufacturing a tubular printing blanket comprising a sleeve translation device for moving a sleeve, the sleeve providing a support layer for the printing blanket; and at least one ribbon casting device applying a flowable material, the flowable material forming a layer disposed over the sleeve. Also disclosed is a method for forming a tubular printing blanket comprising the steps of translating a sleeve in a first direction and ribbon casting at least one of a compressible layer, reinforcing layer and a print layer about the sleeve as the sleeve translates. A related blanket is also provided.

23 Claims, 5 Drawing Sheets

METHOD AND DEVICE FOR MANUFACTURING A TUBULAR LITHOGRAPHIC PRINTING BLANKET

FIELD OF THE INVENTION

The present invention relates to the offset lithographic printing blankets, and more particularly, to tubular offset lithographic printing blankets and methods for manufacturing the same.

BACKGROUND OF THE INVENTION

A web offset printing press typically includes a plate cylinder, a blanket cylinder and an impression cylinder supported for rotation in the press. The plate cylinder carries a printing plate having a rigid surface defining an image to be printed. The blanket cylinder carries a printing blanket having a flexible surface which contacts the printing plate at a nip between the plate cylinder and the blanket cylinder. A web to be printed moves through a nip between the blanket cylinder and the impression cylinder. Ink is applied to the surface of the printing plate on the plate cylinder. An inked image is picked up by the printing blanket at the nip between the blanket cylinder and the plate cylinder, and is transferred from the printing blanket to the web at the nip between the blanket cylinder and the impression cylinder. The impression cylinder can be another blanket cylinder for printing on the opposite side of the web.

A conventional printing blanket is manufactured as a flat sheet. Such a printing blanket is mounted on a blanket cylinder by wrapping the sheet around the blanket cylinder and by attaching the opposite ends of the sheet to the blanket cylinder in an axially extending gap in the blanket cylinder. The adjoining opposite ends of the sheet define a gap extending axially along the length of the printing blanket. The gap moves through the nip between the blanket cylinder and the plate cylinder, and also moves through the nip between the blanket cylinder and the impression cylinder, each time the blanket cylinder rotates.

When the leading and trailing edges of the gap at the printing blanket move through the nip between the blanket cylinder and an adjacent cylinder, pressure between the blanket cylinder and the adjacent cylinder is relieved and established, respectively. The repeated relieving and establishing of pressure at the gap causes vibrations and shock loads in the cylinders and throughout the printing press. Such vibrations and shock loads detrimentally affect print quality. For example, at the time that the gap relieves and establishes pressure at the nip between the blanket cylinder and the plate cylinder, printing may be taking place on the web moving through the nip between the blanket cylinder and the impression cylinder. Any movement of the blanket cylinder or the printing blanket caused by the relieving and establishing of pressure at that time can smear the image which is transferred from the printing blanket to the web. Likewise, when the gap in the printing blanket moves through the nip between the blanket cylinder and the impression cylinder, an image being picked up from the printing plate by the printing blanket at the other nip can be smeared. The result of the vibrations and shock loads caused by the gap in the printing blanket has been an undesirably low limit to the speed at which printing presses can be run with acceptable print quality.

In response to these deficiencies in conventional flat printing blankets, gapless tubular printing blankets were developed by the assignee of the present invention. These gapless tubular printing blankets are described, for example, in U.S. Pat. Nos. 5,768,990, 5,553,541, 5,440,981, 5,429,048, 5,323,702, and 5,304,267.

In this regard, U.S. Pat. No. 5,304,267 is directed to a method of manufacturing a gapless tubular printing blanket. The specification of this patent describes a preferred method of manufacturing a gapless tubular printing blanket as "coating a compressible thread with a mixture of rubber cement and microspheres, and wrapping the coated thread in a helix around the cylindrical sleeve" to form a compressible layer; "coating an inextensible thread with a rubber cement that does not contain microspheres, and wrapping the coated thread in a helix around the underlying compressible layer" to form an inextensible layer, and "wrapping an unvulcanized elastomer over the inextensible layer, securing it with tape" and vulcanizing "the taped structure . . . so that a continuous seamless tubular form is taken by the overlying layers of elastomeric material." Additional methods of manufacture are also described, including the manufacture of a gapless tubular printing blanket having a circumferentially inextensible sublayer comprising a continuous piece of plastic film extending in a spiral through the elastomeric material of an inextensible layer and around a compressible layer. The plastic film preferably has a width approximately equal to the length of the tubular printing blanket, and a thickness of only 0.001 inches so that the narrow scam defined by the 0.001 inch wide edge of the uppermost layer thereof will not disrupt the smooth, continuous cylindrical contour of an overlying printing layer.

DE 197 20 549 A1 purports to describe a method for manufacturing a cylinder carrier by winding of a continuous strip onto a supporting mandrel surface. The strip is unwound from a spool which is mounted so that it can pivot so that the strip winding angle is self adjustable. Strip tension is maintained during the winding process. Preliminary conditioning treatment and coating of the strip with an adhesive takes place between unwinding and winding of the strip. The preliminary treatment stations are mounted on a support wall which is installed so that it can pivot relative to the cylinder surface. The cylindrical carrier shell is coated with an integral layer of plastic material. The carrier shell is shown as having a fixed length.

SUMMARY OF THE INVENTION

The methods for manufacturing gapless tubular printing blankets described above suffer from the deficiency that they produce blankets in batch mode (i.e. one at a time) with a fixed axial length. Batch mode production increases production costs, increases production time, and results in batch to batch variability in the blankets produced.

Commonly-assigned U.S. Pat. No. 6,257,140, filed Dec. 27, 1999 and which is hereby incorporated by reference herein, describes gapless tubular printing blankets produced continuously and cut to length as desired. The sleeve and print layer are "continuously" formed in that the sleeve forming station continues to form an additional portion of the sleeve while the print layer forming station applies the print layer to the previously formed portion of the sleeve. Wound tapes or cross-head extruders are used to apply various layers.

The present invention provides for ribbon casting of materials to form various layers of a tubular printing blanket. "Ribbon casting" as defined herein can mean that a liquid material is deposited from a stationary source onto a rotating and translating substrate or that a liquid is deposited from a rotating source onto a translating substrate. A continuous ribbon of liquid material thus can be placed on the substrate.

"Liquid material" as defined herein can be any flowable material, including a semi-solid material. The liquid material preferably is a polymer which does not require a separate curing step, i.e. a self-cure material. Since the liquid can be sent out from a single orifice of the source, the depositing of the material to form the blanket is simpler than a cross-head extruder, in which material is forced out so as to contact the entire circumference of the substrate. Moreover, liquid materials are simpler to use than tape materials.

The present invention thus provides a device for manufacturing a tubular printing blanket comprising:

a sleeve translation device for moving a sleeve, the sleeve providing an innermost support layer for the printing blanket; and at least one ribbon casting device applying a flowable material, the flowable material forming a layer disposed over the sleeve.

The present device provides for more cost-effective and quicker manufacture of printing blankets. The cost of tubular blankets is a large factor in the overall costs of operating a printing press using tubular printing blankets.

The at least one ribbon casting device preferably includes a compressible layer ribbon casting device having a first supply area for a flowable material and a compressibility forming device, which can for example be a supply area for compressible microspheres or an air blower or foamer. The foam structure or the microspheres can provide the compressibility desirable for the compressible layer.

The at least one ribbon casting device also preferably includes a reinforcing layer ribbon casting device and a print layer ribbon casting device.

The ribbon casting devices preferably have a single nozzle through which the flowable material flows onto the respective substrate.

Preferably, the ribbon casting devices are stationary, and the sleeve translating device is a translating and rotating device, on which a continuous sleeve is being formed, for example using a metal tape.

Alternatively, the ribbon casting devices may rotate in a circular motion about the substrate and the sleeve translating device may continuously translate a sleeve substrate past the ribbon casting devices.

The present invention provides a method for forming a tubular printing blanket comprising the steps of:

translating a sleeve in a first direction; and ribbon casting at least one of a compressible layer, reinforcing layer and a print layer about the sleeve as the sleeve translates.

Preferably, the method further includes rotating the sleeve during the translating step. The ribbon casting step preferably includes ribbon casting a compressible layer, a reinforcing layer and a print layer.

Alternately, the ribbon casting step may include rotating a ribbon casting device about the sleeve as the sleeve translates.

While rubber could be used for ribbon casting, the rubber then typically is cured in a separate step. It is highly advantageous that a polymer which does not need a separate curing step be used in the ribbon casting process, such a polymer being defined herein as a "self-cure polymer". Most preferably, urethane is used to form blankets according to the present invention. Urethane has the advantages of flowing well during a ribbon casting and of setting quickly. However, the self-cure polymer also could be a self-vulcanizing rubber such as RTV (room temperature vulcanizing) rubber.

The ribbon casting step thus preferably includes ribbon casting urethane to form the at least one layer.

Preferably, the blankets are formed continuously so as to have an indeterminate length. The method then further includes the step of cutting the sleeve to a desired length so as to form the blanket.

The present invention also provides a tubular printing blanket comprising a sleeve, a compressible layer and a print layer, at least one of the compressible layer and the print layer being made of urethane.

Preferably, both the compressible layer and the print layer are made of urethane, and a reinforcing layer is located between the compressible layer and the print layer. The reinforcing layer is also preferably made of urethane.

Preferably, the compressible layer is made of urethane foam formed by blowing carbon dioxide, air or another blowing agent into the urethane before it exits the nozzle of a ribbon casting device. Compressible microspheres however could also be embedded in the urethane to provide the compressibility.

The reinforcing layer preferably is made of a high durometer urethane of greater than 80 shore A, most preferably about 100 shore A. The reinforcing layer preferably is thinner than the compressible layer.

The print layer preferably is made of a urethane with a durometer of less than 80 shore A and most preferably of about 60 shore A.

Similar durometer values can be provided for blankets according to the present invention made with self-cure polymers other than urethane.

The layers preferably are provided by ribbon casting which forms a spiral shape which melds together to form uniform gapless layers.

The sleeve preferably is made of steel, preferably formed by a ribbon in a continuous fashion.

BRIEF DESCRIPTION OF THE DRAWINGS

The present invention is described in more detail with reference to the following figures, in which.

DETAILED DESCRIPTION OF THE PREFERRED EMBODIMENTS

Figure 1:
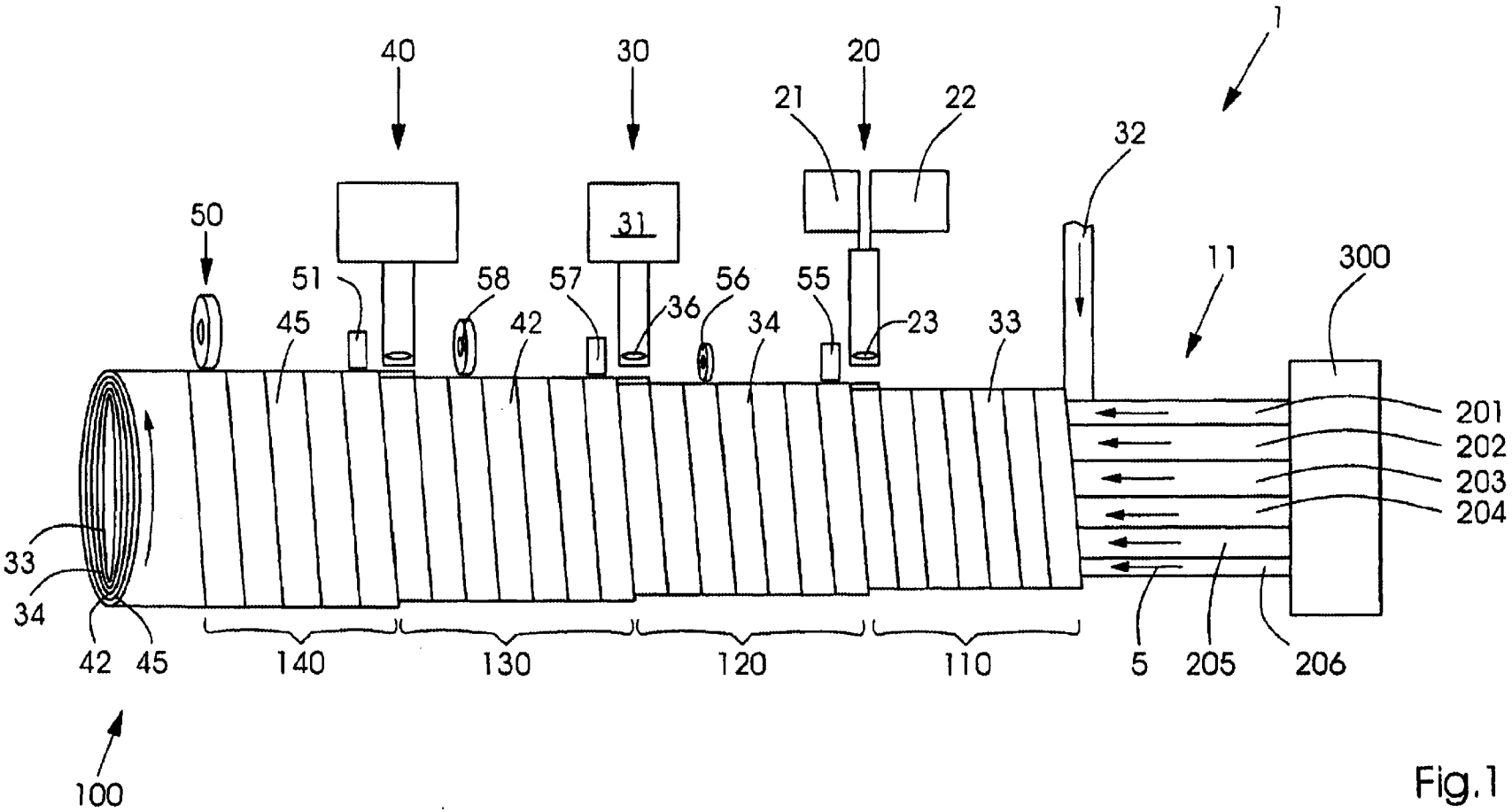
FIG. 1 shows a device for manufacturing a tubular printing blanket according to the present invention, schematically showing the end of the printing blanket for clarity purposes only.

FIG. 1 shows a device 1 for manufacturing a continuous process gapless tubular printing blanket 100. In this regard, the term "continuous process" indicates that the process creates a continuous tubular blanket of undetermined axial length.

Device 1 includes a rotating and translating device 11 for moving the blanket 100 in a continuous fashion from right to left in FIG. 1. Device 11 has an actuating section 300 which continuously rotates and translates movable slats 201, 202, 203, 204, 205, 206, etc., as will be described with reference to FIGS. 2*a* and 2*b*.

In a first station 110, a tape 32, preferably made of steel and which may include two overlapping pieces of tape, is fed to device 11, which unwinds the tape so as to form an underlying sleeve 33.

At a second station 120, a compressible layer ribbon casting device 20 of device 1 has a urethane supply 21 and a blower 22. Urethane supply 21 can include a plurality of separate sections, such as an isocyanate section, a curative section and a mixing chamber, as well as other material sections. Urethane from supply 21 is foamed by the blower 22 in the mixing chamber and exits a nozzle 23 having an end orifice. The foamed urethane is thus deposited over the sleeve 33 to form a compressible layer 34, which is shown for clarity with the deposited liquid ribbons in a spiral fashion. In actuality, the deposited liquid ribbons flow together and set to form a seamless, gapless compressible layer 34.

A doctor blade or scraper 55 may contact the urethane layer 34, and a grinding device 56 can smooth layer 34 to reduce imperfections such as undulations in layer 34.

Over this compressible layer 34 is deposited, by a second ribbon casting device 30 of device 1, a reinforcing layer 42 in section 130. The ribbon casting device 30 can have a urethane supply 31 and a nozzle 36 for depositing the urethane. The durometer of the urethane preferably is about 100 shore A. Again, the deposited urethane flows together sets to form a seamless and gapless reinforcing layer 42. A scraper 57 and grinding device 58 may be employed to reduce imperfections in layer 42.

A third ribbon casting device 40 similar to device 30 provides a ribbon of urethane to form a print layer 45 over the reinforcing layer 42. The urethane of the print layer preferably has a shore A durometer value of about 60. The deposited print layer forms a seamless and gapless layer when it sets. If desired, a scraper 51 and a grinding device 50 may be used to correct or reduce any imperfections such as undulations in the print layer 45.

Once the print layer 45 is complete, the blanket continues moving in the direction of arrows 5 until a desired length is reached, at which time the blanket is cut, for example by a rotating cutter or saw.

In section 110, the sleeve is supported by the slats 201–210 (See FIGS. 2*a* and 2*b*), and may be supported in sections 120, 130 and 140 by interior bearings.

Figure 2A:
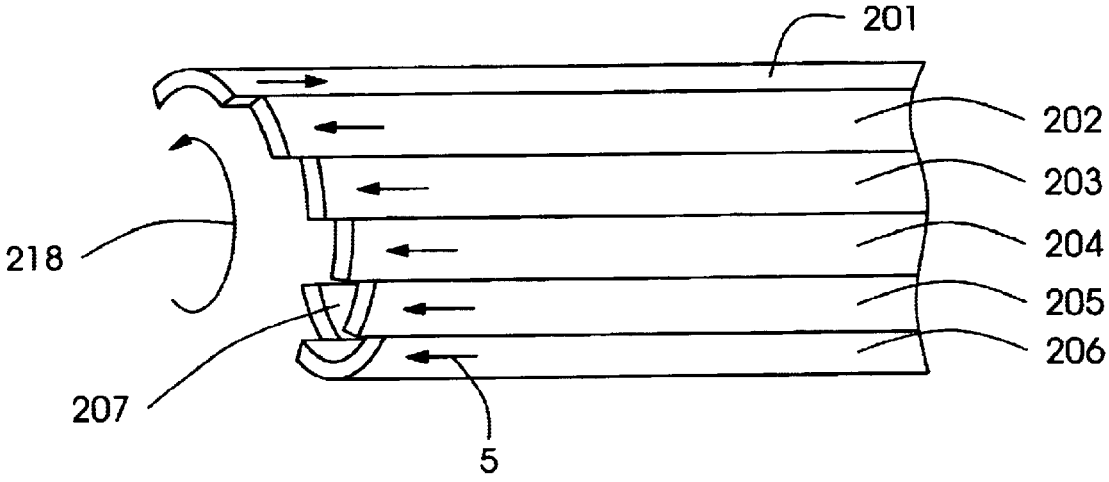
FIGS. 2*a* and 2*b* show details of the rotating and translating device for preparing a continuous tubular printing blanket.

FIG. 2*a* shows more detail of the functioning of slats 201, 202, 203, 204, 205, 206, 207, which rotate in direction 218. At the same time the slats rotate, nine of the ten slats are translating in direction 5. When a slat reaches a furthest axial location in direction 5, it is pulled back opposite direction 5 as shown with slat 201 in FIG. 2*a*. This motion does not hinder the translation of the sleeve in direction 5, as the other nine slats are still pushing the sleeve in direction 5. Slat 201 once pulled back begins moving again in direction 5.

Figure 2B:
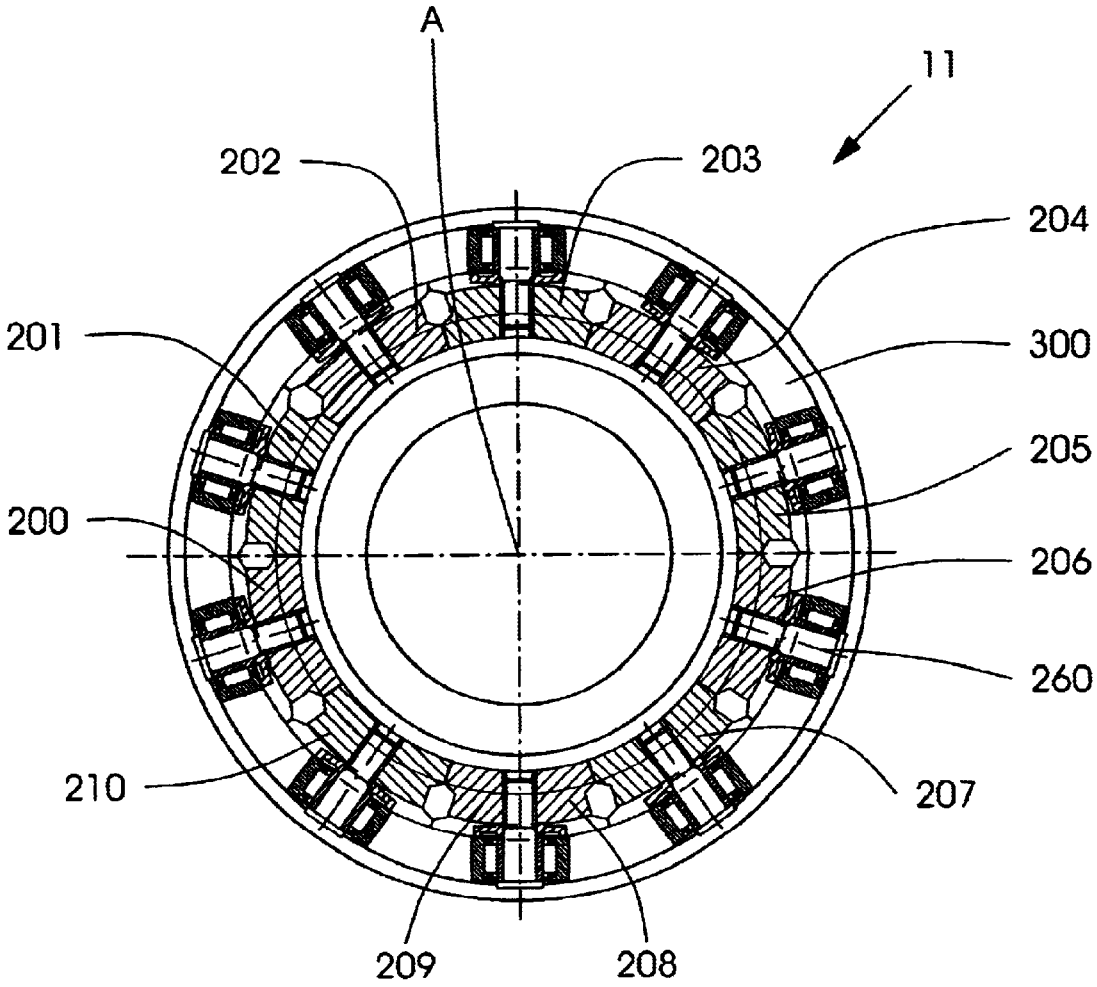

FIG. 2*b* shows a cross sectional view of the slats 201, 202, 203, 204, 205, 206, 207, 208, 209 and 210 along with the actuating device 300 which rotates and translates the slats through, for example, bearings 260.

Figure 3:
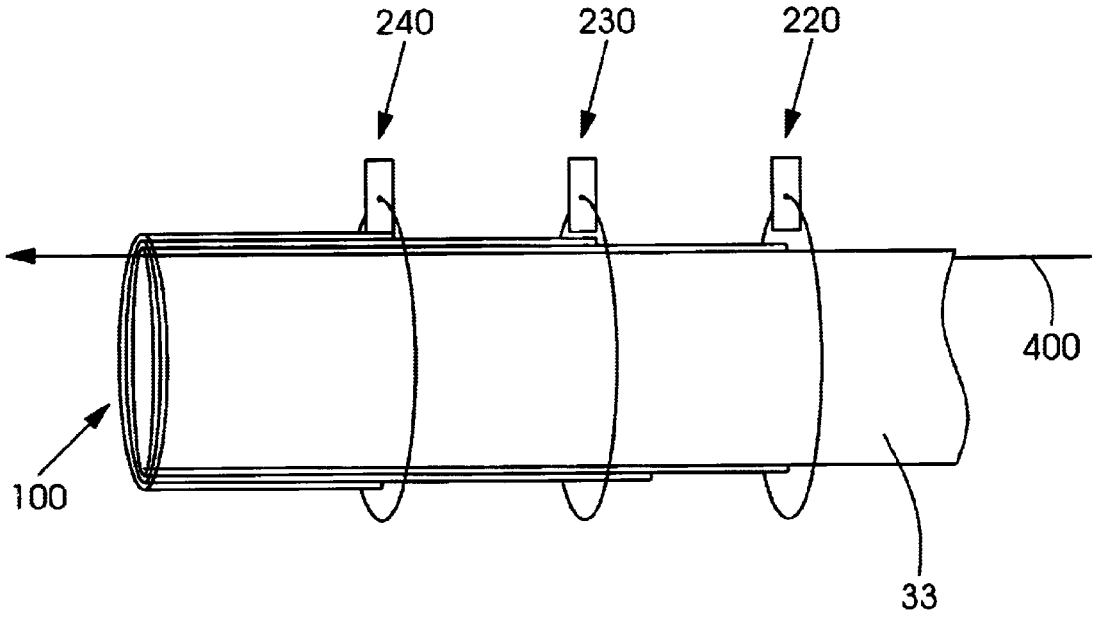
FIG. 3 shows an alternate embodiment of the manufacturing device of the present invention in which the ribbon casting devices rotate about the substrate.

FIG. 3 shows an altemnate embodiment in which the sleeve 33 is transported by a transport device 400 through three rotating ribbon casting devices 220, 230, 240, which deposit the compressible layer, reinforcing layer and print layer, respectively. The layers may be of similar materials as the layers 34, 42 and 45 shown in FIG. 1.

Figure 4:
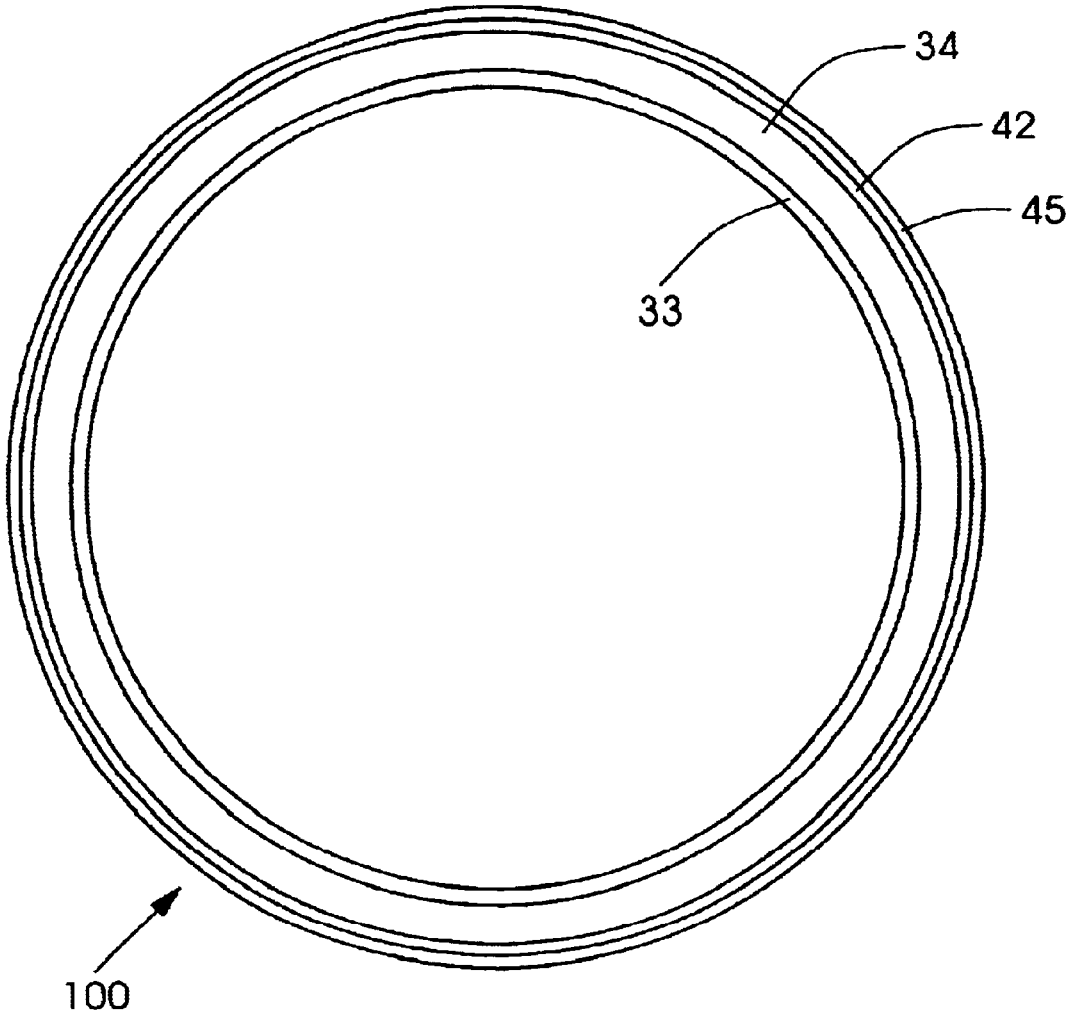
FIG. 4 shows a cross-sectional view of a blanket according to the present invention.

FIG. 4 shows a cross-sectional view of the blanket 100, with sleeve 33, compressible layer 34, reinforcing layer 42 and print layer 45.

As used herein, the term "compressible layer" refers to a polymeric material which has been made compressible in any manner known in the art, including for example, through the use of microspheres, blowing agents, foaming agents, or leaching. Examples of such materials are disclosed for example in U.S. Pat. Nos. 5,768,990, 5,553,541, 5,440,981, 5,429,048, 5,323,702, and 5,304,267.

As used herein, the term print layer, printing layer or elastomeric print transferring material refers to an polymeric material such as urethane which is suitable for transferring an image from a lithographic printing plate or other image carrier to web or sheet of material, with such print quality as the particular printing application requires.

Although the preferred embodiments of the continuous process lithographic printing blanket in accordance with the present invention has been illustrated herein as including a compressible layer, a reinforcing layer, and a print layer, it should be understood that, if desired for a particular application, the blanket may also include a base build-up layer between the sleeve 33 and the compressible layer 34.

In addition, it should be understood that while the blanket in accordance with the present invention preferably includes a compressible, reinforcing, and print layers, it is also possible to prepare blankets with fewer or additional layers. For example, if appropriate for a particular application, a blanket in accordance with the present invention may be comprised of a sleeve and a print layer; or a sleeve, a compressible layer, and a print layer. Moreover, it should be understood that a blanket in accordance with the present invention might also include multiple compressible layers, multiple build up layers, or multiple reinforcing layers.

With regard to the reinforcing layer, although the reinforcing layer is preferably formed from urethane, the reinforcing layer also may be formed by winding fabric or plastic tape, cords or threads around the work piece. Morever, cross-head extruders or tape could be used to form some of the layers not formed by ribbon casting.

The temperature of the flowable material may be controlled by the respective ribbon casting devices. Moreover, the nozzles may have orifices, the shape of which can be altered to effect a change in the ribbon dimensions. Preferably, the temperature and shape of the nozzles is such that a steady stream of flowable material flows onto the substrate. The flow rate, temperature, nozzle shape and speed of rotation of the substrate can be altered to provide the desired characteristics for the various layers, such as the thickness of the layer.

What is claimed is:

1. A device for continuously manufacturing a tubular printing blanket comprising:

a sleeve translation device for continuously axially moving a sleeve through contact with an interior of the sleeve; and at least one ribbon casting device applying a flowable material, the flowable material forming a layer disposed over the sleeve.

2. The device as recited in claim 1 wherein the at least one ribbon casting device includes a first supply area for a flowable material and a compressibility forming device.

3. The device as recited in claim 2 wherein the compressibility forming device is a foamer.

4. The device as-recited in claim 2 wherein the at least one ribbon casting device includes two ribbon casting devices.

5. The device as recited in claim 2 wherein the at least one ribbon casting device includes a first ribbon casting device and a second ribbon casting device axially spaced from the first ribbon casting device.

6. The device as recited in claim 1 wherein the at least one ribbon casting device has a single nozzle through which the flowable material flows.

7. The device as recited in claim 1 wherein the at least one ribbon casting device is stationary and the sleeve translating device is a translating and rotating device.

8. The device as recited in claim 7 further comprising a metal tape dispensing device for continuously forming the sleeve.

9. The device as recited in claim 1 wherein the at least one ribbon casting device is rotatable about the sleeve.

10. The device as recited in claim 1 further comprising a grinding station located downstream from the least one ribbon casting device.

11. A method for forming a tubular printing blanket comprising the steps of:

translating a sleeve in a first direction by continuously axially moving the sleeve via an interior of the sleeve; and ribbon casting at least one of a compressible layer, reinforcing layer and a print layer about the sleeve as the sleeve translates.

12. The method as recited in claim 11 further comprising rotating the sleeve during the translating step.

13. The method as recited in claim 11 wherein the compressible layer and the print layer are ribbon cast.

14. The method as recited in claim 11 wherein the ribbon casting step includes ribbon casting the compressible layer, the reinforcing layer and the print layer.

15. The method as recite in claim 11 wherein the ribbon casting step includes rotating a ribbon casting device about the sleeve as the sleeve translates.

16. The method as recited in claim 11 wherein the at least one of the compressible layer, the reinforcing layer and the print layer is made of urethane.

17. The method as recited in claim 11 wherein the at least one of the compressible layer, the reinforcing layer and the print layer is made of a self-cure polymer.

18. The method as recited in claim 11 wherein the sleeve is formed continuously.

19. The method as recited in claim 11 further including cutting the sleeve to a desired length.

20. The method as recited in claim 14 further comprising grinding the at least one of the compressible layer, the reinforcing layer and the print layer.

21. The method as recited in claim 11 wherein the blanket is formed continuously.

22. A method for making a blanket comprising the steps of:

moving continuously axially a sleeve axially through interior contact with the depositing a compressible layer of urethane over the sleeve; and depositing a print layer made of urethane over the compressible layer.

23. The method as recited in claim 22 further comprising depositing a reinforcing layer of urethane over the compressible layer.

* * * * *